US005819545A

United States Patent [19]

Eacobacci, Jr. et al.

[11] Patent Number: 5,819,545

[45] Date of Patent: Oct. 13, 1998

[54] CRYOPUMP WITH SELECTIVE CONDENSATION AND DEFROST

[75] Inventors: Michael J. Eacobacci, Jr., Weymouth; Stephen R. Matté , Norfolk, both of Mass.

[73] Assignee: Helix Technology Corporation, Mansfield, Mass.

[21] Appl. No.: 978,463

[22] Filed: Nov. 25, 1997

Related U.S. Application Data

[63] Continuation of Ser. No. 919,685, Aug. 28, 1997, abandoned.

[51] Int. Cl.[6] ..... B01D 8/00

[52] U.S. Cl. ..... 62/55.5; 62/921

[58] Field of Search ..... 62/55.5, 921

[56] References Cited

U.S. PATENT DOCUMENTS

| | | | |
|---|---|---|---|
| 4,679,402 | 7/1987 | Andeen | 62/55.5 |
| 4,910,965 | 3/1990 | Lepofsky et al. | 62/55.5 |
| 5,062,271 | 11/1991 | Okumura et al. | 62/55.5 |
| 5,261,244 | 11/1993 | Lessard et al. | 62/55.5 |
| 5,375,424 | 12/1994 | Bartlett et al. | 62/55.5 |
| 5,400,604 | 3/1995 | Häfner et al. | 62/55.5 |
| 5,483,803 | 1/1996 | Matté et al. | 62/55.5 |
| 5,513,499 | 5/1996 | deRijke | 62/55.5 |

OTHER PUBLICATIONS

Comello, Vic, "Cryo Regeneration Times Keep Getting Shorter," *R&D Magazine*, pp. 47–49, (Aug. 1992).

Scholl, Richard A., "Cryopumping in Semiconductor Applications," Solid State Technology, pp. 187–190, (Dec. 1983).

Häfner, H–U, et al., "New methods and investigations for regenerating refrigerator cryopumps," *Vacuum*, 41(7–9):1840–1842, (1990).

Daleiden, J., et al., "Chemical analysis of a $CI_2/BCI_3/IBr_3$ chemically assisted ion–beam etching process for GaAs and InP laser–mirror fabrication under cryo–pumped ultrahigh vacuum conditions," *J. Vac Sci. Technol.,* 13(5):2022–2024, (Sep./Oct. 1995).

*Primary Examiner*—Ronald C. Capossela

*Attorney, Agent, or Firm*—Hamilton, Brooke, Smith & Reynolds, P.C.

[57] ABSTRACT

The cryopanel of a cryopump can be preferentially defrosted to remove an acid-forming or toxic gas while leaving a second gas substantially condensed upon the cryopanel thereby limiting interaction between the vapor phases of the two gases. The cryopanel is warmed to a temperature within a selective defrost range at which the first gas selectively sublimates from the cryopanel. The temperature of the cryopanel is then maintained at a temperature within this range until the cryopanel is substantially cleared of the first gas leaving the second gas substantially undisturbed as a condensate upon the cryopanel. In a preferred embodiment, the cryopanel is maintained at about 50 to 85K during standard operation before being defrosted.

24 Claims, 3 Drawing Sheets

CRYOPUMP WITH SELECTIVE CONDENSATION AND DEFROST

RELATED APPLICATIONS

This application is a Continuation of U.S. Ser. No. 08/919,685 filed Aug. 28, 1997, now abandoned, the entire teachings of which are incorporated herein by reference.

BACKGROUND OF THE INVENTION

Cryopumps create exceptionally-low-pressure vacuum conditions by condensing or adsorbing gas molecules onto cryopanels cooled by cryogenic refrigerators. Commonly, a cryopump used in this context is cooled by a refrigerator performing a Gifford-McMahon cooling cycle. These refrigerators generally include one or two stages, depending upon which gases are sought to be removed from the controlled atmosphere. Two-stage cryopumps are used when removal of low-condensing-temperature gases, such as nitrogen, argon and hydrogen is desired. The second stage is typically operated at approximately 15 to 20K to condense these gases upon a cryopanel thermally coupled to the second stage of the refrigerator.

In contrast, a single-stage cryopump, also known as a waterpump, is typically operated at warmer temperatures than the second stage of a two-stage cryopump, typically at about 107K. Operating at this temperature, a single-stage cryopump will nearly eliminate the presence of water vapor and will also condense a significant quantity of chlorine.

In the refrigerator of a typical cryopump, the flow of compressed-gas refrigerant is cyclic. A compressor supplies compressed gas to the refrigerator through a supply line leading to an inlet valve. An exhaust valve leading to an exhaust line returns the refrigerant from the refrigerator to the low-pressure inlet of the compressor. Both valves are located at the first end of a cylinder within the refrigerator. At the opposite, second end of the cylinder, a thermal load, including a cryopanel, is thermally coupled to the cylinder.

With a displacer including a regenerative heat exchange matrix (regenerator) at a second end of the cylinder, and with the exhaust valve closed and the inlet valve open, the cylinder fills with compressed gas. With the inlet valve still open, the displacer moves to the first end to force compressed gas through the regenerator, the gas being cooled as it passes through the regenerator. The inlet valve is then closed and the exhaust valve is opened, and the gas expands into the low-pressure exhaust line and cools further. The resulting temperature gradient across the cylinder wall at the second end causes heat to flow from the thermal load to the gas within the cylinder. With the exhaust valve opened and the inlet valve closed, the displacer is then moved to the second end, displacing gas back through the regenerator which returns heat to the cold gas, thus cooling the regenerator and completing the cycle.

To produce the low temperatures required for cryopump uses, the incoming gas must be cooled before expansion. In the process outlined, above, the regenerator extracts heat from the incoming gas, stores it, and then releases it to the exhaust stream. A regenerator is a reversing-flow heat exchanger through which the helium passes alternately in either direction. It comprises a material of high surface area, high specific heat, and low thermal conductivity. Thus, the regenerator will accept heat from the helium when the helium's temperature is higher. When the helium's temperature is lower, e.g., when the helium cools following expansion into the exhaust line, the regenerator releases heat to the helium. The heat released by the regenerator is extracted from the cryopanel, thereby cooling the cryopanel.

As layers of condensed gases accumulate upon the cryopanel, the effectiveness of the cryopump is gradually compromised, and the volume of available pumping space may be depleted. To remedy this loss, both single-stage and two-stage cryopumps are routinely subjected to regeneration procedures. During a regeneration procedure, the cryopanel, which is coated with a layer of condensed gases, is warmed well above its operating temperature to sublimate or to liquefy and evaporate the gases condensed upon it. The liberated gases are typically removed from the surrounding vacuum chamber by a rough pump, and the cryopanel is returned to its cold, operating temperature. The regeneration procedure thereby cleans the surface of the cryopanel of accumulated condensates. Because the operation of the cryopanel ceases during the regeneration procedure, the frequency and duration of the required regeneration cycles become critical.

DISCLOSURE OF THE INVENTION

Regeneration may cause damage to the system and may present health risks if performed indiscriminately. For example, chlorine gas ($Cl_2$) is routinely used in semiconductor etching processes which commonly incorporate the use of a cryopump. When chlorine gas is present in a chamber of a process tool where a cryopump is operating, the chlorine gas typically condenses upon the cryopanel along with condensed water.

At least two significant dangers are created by this state. First, liberating the chlorine simultaneously with water can initiate a reaction between the two. This reaction produces hydrochloric acid (HCl). Hydrochloric acid is highly corrosive, and, therefore, may damage the chamber, the work pieces within it, and the cryopump. Moreover, the production of hydrochloric acid creates disposal problems as well as a health hazard for individuals in contact with the process tool. Second, chlorine gas, alone, presents a health hazard. As it accumulates on the cryopanel over time, the chlorine presents an increasing health risk upon its eventual liberation. If left to accumulate unabatedly, a dangerous concentration of chlorine gas can be released when a chamber is vented to the outside atmosphere after the refrigerator has warmed or in the event of a sudden power outage.

The risks presented by chlorine can be minimized by limiting both the accumulation of chlorine upon the cryopanel and the interaction between chlorine and water vapor through selective release and removal of the chlorine from the cryopanel at periodic intervals. In accordance with one aspect of the invention, a toxic or acid-forming gas can be selectively removed from a cryopanel, upon which multiple gases are condensed, by warming the cryopanel to a temperature within a selective defrost range. At temperatures within this selective defrost range, the toxic or acid-forming gas will selectively release from the cryopanel as a vapor, while the gas with which it is reactive, e.g., water, will remain substantially condensed upon the cryopanel. The temperature of the cryopanel is maintained within this range until the toxic or acid-forming gas is substantially released from the cryopanel and removed from the surrounding chamber. Preferably, the process of removing the liberated gas from the chamber continues at least until the vapor pressure within the chamber drops below about 0.01 torr.

In accordance with a further aspect of this invention, the range of selective defrost temperatures at which the cryopanel is maintained is below the triple point of the selectively-removed gas. Where the selectively-removed gas is chlorine, the cryopanel is preferably cooled by a single-stage refrigerator performing a Gifford-McMahon cooling cycle, and the selective defrost range is preferably between about 115 and 180K. After the selective removal of condensed gas, the cryopanel can be alternatively cooled back down to its operating temperature or warmed further to perform a full regeneration releasing other gases condensed upon the cryopanel.

In a preferred embodiment, the temperature at which the cryopanel is maintained during pumping is between about 50 and 85K. Within this temperature range, nearly all of the chlorine vapor within the chamber is condensed. Where another hazardous gas, such as hydrogen bromide, is present within the chamber, the operating temperature of the cryopanel may be dropped even lower, for example, to a temperature between about 35 and 75K to condense nearly all of the hazardous gas from the chamber onto the cryopanel. The practice of operating the cryopanel at temperatures within these ranges during condensation can be used in conjunction with the preferential defrost procedures outlined above.

In a further preferred embodiment, an electronic module is programmed to warm the cryopanel to a temperature within a range at which a first condensed gas, such as chlorine or fluorine, selectively sublimates from the cryopanel while a second condensed gas, such as water, remains condensed. The electronic module is further programmed to maintain the temperature within this range until the first condensed gas is substantially released from the cryopanel.

BRIEF DESCRIPTION OF THE DRAWINGS

The foregoing and other objects, features and advantages of the invention will be apparent from the following, more particular description of preferred embodiments of the invention, as illustrated in the accompanying figures. The drawing is not necessarily to scale, emphasis instead being placed upon illustrating the principles of the invention.

DETAILED DESCRIPTION OF PREFERRED EMBODIMENTS

Cryopumps are often used in applications where ambient gases include those that are inherently either hazardous or reactive with other condensed gases to form hazardous products. For example, cryopumps are routinely used in the fabrication of electronic devices, microelectronics, flat panel displays, and magnetic media. Each of these processes necessitates the use of a dry etch process performed in vacuum pressure regimes of 50 to 200 mtorr. Often, chlorine, boron trichloride ($BCl_3$) and hydrogen bromide (HBr) are used to etch the processed articles.

The reaction of residual and outgas chlorine and chlorine derivatives with various materials of construction has produced significant corrosion within the load locks and transfer chambers of dry etch tools. Additionally, these corrosive reactions create particles which may damage the substrates being processed. In some instances, the substrates are also damaged by excessive corrosion caused by an uncontrolled chlorine reaction on the substrates' surfaces. Chlorine is most hazardous in its vapor phase. This hazard can therefore be reduced by condensing chlorine from its vapor phase to a solid phase using a single-stage cryopump.

Figure 1:
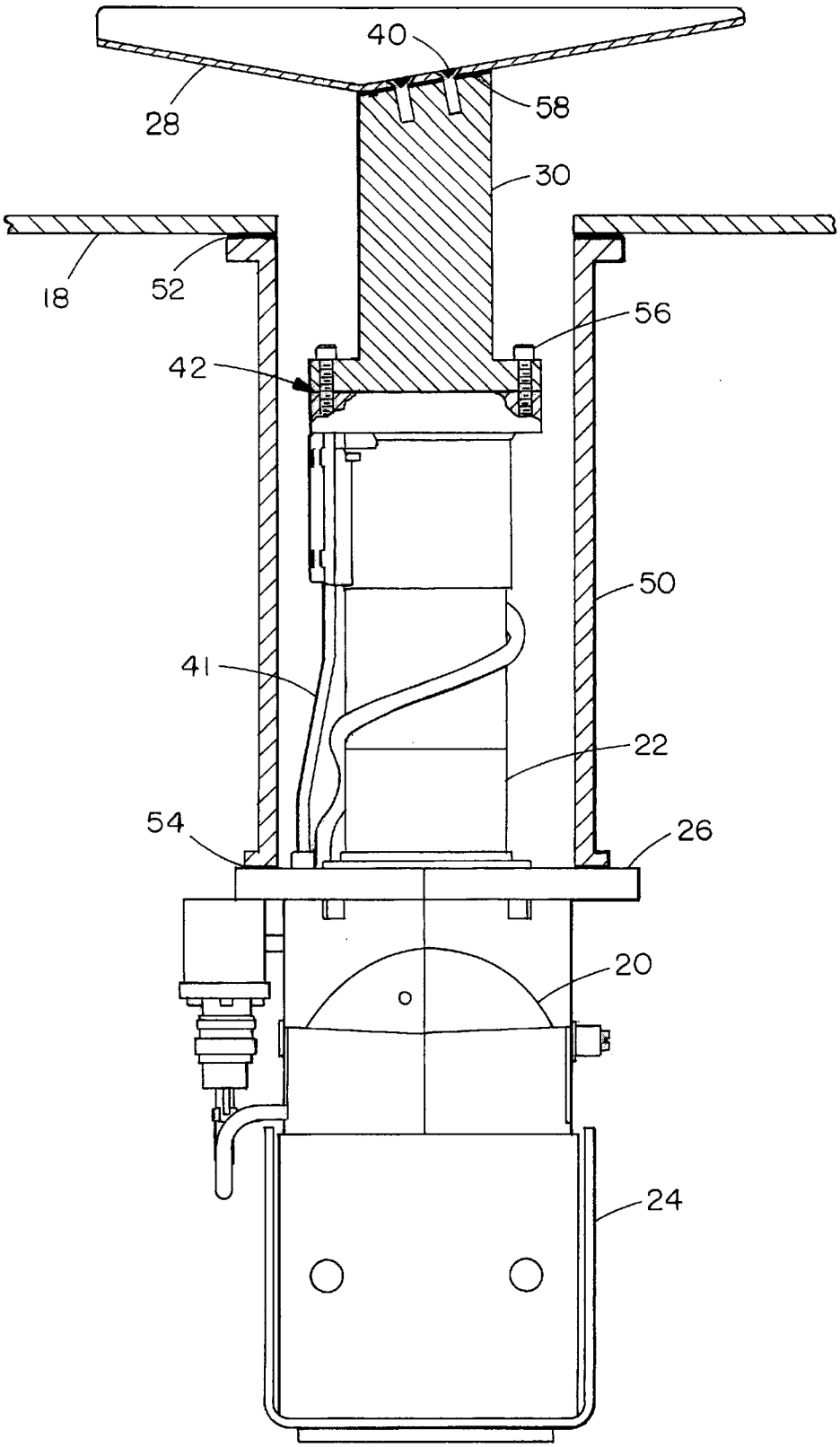
FIG. 1 illustrates a side view, partially in cross section of a single-stage cryopump.

A single-stage cryopump suitable for semiconductor manufacturing processes is illustrated in FIG. 1. The cryopump is mounted to the walls 50 of a coupling vessel through a flange 26. The coupling vessel walls 50, in turn, are mounted to a wall 18 of a vacuum chamber. The cryopump thereby projects into the vacuum chamber, which may be a load lock or a transfer chamber, at a cold finger 22 or at a thermally-conductive post 30 of the cryopump. The thermally-conductive post 30 preferably comprises copper or aluminum. The thermally-conductive post 30 is mounted to the cold finger 22 with bolts 56 and with an indium sheet 42 forming an interface between the post 30 and the cold finger 22. A cryopanel 28 is similarly mounted to the thermally-conductive post 30, with a second indium sheet 58 likewise positioned between the mounted surfaces. A heater 41 is controlled by an electronic module 24 to warm the cryopanel 28 to reach or maintain a desired temperature.

The air-tight integrity of the chamber across the interfaces of the vacuum chamber wall 18, coupling vessel walls 50 and cryopump is maintained by seals positioned at the junctures of each of these elements. A first seal is provided by an O-ring 52 placed between the coupling vessel walls 50 and the vacuum chamber wall 18. At the opposite ends of the walls 50 of the coupling vessel, another seal 54 is placed between the coupling vessel 50 and the flange 26.

One method for removing and isolating a hazardous vapor, such as chlorine, includes condensing the hazardous vapor upon a cryopanel operated at a temperature specifically selected to increase the condensation of the hazardous gas as well as to improve the efficiency of cryopump operation. For example, by lowering the temperature of the cryopanel to below 80K, several advantages are provided over the typical operation at 107K. First, when the temperature drops from 107 to 80K, the vapor pressure of chlorine drops from nearly $10^{-4}$ torr to $10^{-9}$ torr. By reducing the amount of chlorine vapor during standard operation by a factor of nearly $10^5$, the corrosive effect of chlorine is greatly reduced.

Figure 2:
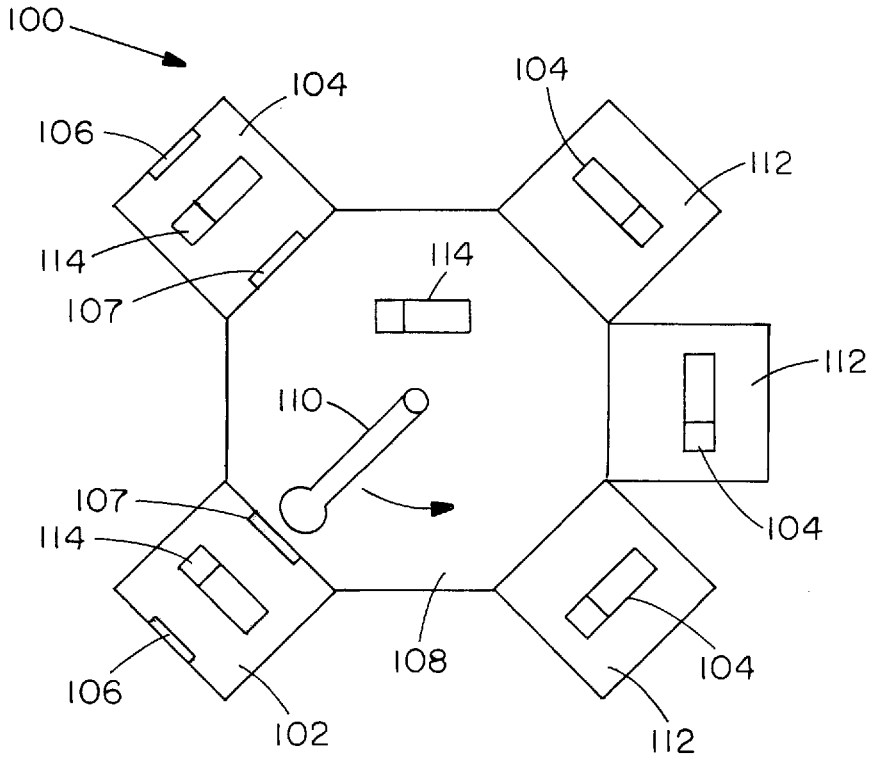
FIG. 2 is a cross-sectional overhead view of a cluster process tool.

Second, a temperature setting of 80K or less is low enough to condense a sufficient amount of gas to maintain the necessary low pressure in the transfer chamber of a dry etch tool. A dry etch tool is illustrated in FIG. 2, and its operation is augmented by the use of a cryopanel 114 in each of an entrance load lock 102, a transfer chamber 108, a plurality of process chambers 112, and an exit load lock 104. In the manufacture of semiconductors, the transfer chamber 108 is typically operated in a pressure range of $10^{-7}$ torr to 400 mtorr. To maintain the pressure within or below this range, chlorine within the chamber 108 must be substantially condensed on the cryopanel 114. Like all gases, the vapor pressure of chlorine drops with decreasing temperature. At 80K, the vapor pressure of chlorine is approximately $10^{-9}$ torr.

Where hydrogen bromide, another hazardous processing gas, is used in a cluster process tool, the operating temperature of the cryopump may be dropped to 35 to 65K to decrease the vapor pressure of hydrogen bromide to levels (approximately $10^{-9}$ torr) as low as those reached for chlorine, above.

The cryopump within each of the load locks 102 and 104 of a cluster process tool is typically operated at 80 to 150K, and the pressure within the locks 102 and 104 may be as high as one torr. Because of the comparatively high pressure within the locks 102 and 104, the locks 102 and 104 can accommodate a much higher vapor pressure of chlorine and other gases, as compared to the transfer chamber 108. As a result, cryopanels 114 in the load locks 102 and 104 can be operated at temperatures higher than that of the cryopanel 114 in the transfer chamber 108. In addition to removing a sufficient amount of chlorine from the atmosphere, cryopanels 114 operating at 80–150K remain sufficiently cold to maintain a low background water vapor pressure in the locks.

To prevent corrosion of the cryopanel when chlorine or hydrogen bromide is condensed, the cryopanel is preferably coated with a corrosion-resistant polymer. Aluminum is preferably used as the underlying material of the cryopump. Preferably, the polymer coating applied to the aluminum is a halogenated or perhalogenated alkenyl or alkoxy polymer of $C_1$ to $C_4$ repeat units, including copolymers thereof, wherein the repeat units are substantially halogenated with fluorine, chlorine or combinations thereof.

In addition to, or in place of, the improved condensation procedure, described above, an alternative method for selectively managing the presence and removal of chlorine vapor includes the use of a preferential defrost procedure which reduces the risk of hazardous reactions between chemicals as well as the risk of a concentrated release of hazardous vapor. In cryopumping operations, an especially dangerous condition is created if a large quantity of condensed chlorine is suddenly sublimated to produce a concentrated cloud of chlorine gas. Chlorine gas may abruptly sublimate from the cryopanel as a result of a number of occurrences including power failure and mechanical malfunctions. As the cryopanel warms, chlorine may be among the first gases to sublimate in substantial quantities. When the chamber is vented after such an occurrence, as it may be to allow for loading or maintenance, the vaporized chlorine presents a substantial hazard for an individual manually performing maintenance or loading or unloading a vented chamber. A substantial hazard also exists for those who are merely in the proximity of the chamber, none of whom may have received warning about the dangerous condition.

A particular hazard of chlorine release exists in the loading and unloading of load locks in a cluster process tool where dry etching is performed. A cluster process tool suitable for dry etching and other semiconductor manufacturing processes is illustrated in FIG. 2. The process tool 100 typically includes a plurality of interconnected chambers including an entrance load lock 102, an exit load lock 104, and process chambers 112. Each of the vacuum-isolated load locks 102 and 104 includes a cryopump 114 and a pair of slidable doors 106 and 107. An exterior door 106 opens to the outside atmosphere, and an interior door 107 opens to a transfer chamber 108 which serves as the hub of the process tool 100. Process chambers 112, where manufacturing processes such as etching are performed, open to the transfer chamber 108 along its periphery. Within the transfer chamber 108, a robotic arm 110 rotates to transfer elements among the chambers. The necessary vacuum within the transfer chamber 108 and process chambers 112 is maintained by cryopumps 114 placed within each of the chambers.

In a typical operation of the process tool 100, the exterior door 106 of the entrance load lock 102 opens. While the exterior door 106 is open, semiconductor wafers are manually inserted into the lock 102 through the exterior door 106. After the door 106 is resealed, a roughing pump reduces the pressure within the load lock to about $10^{-3}$ torr while a cryopump 114 condenses gases including water, $Cl_2$, HBr and HCl to achieve significantly lower pressures. The dual action of these pumps thereby reestablishes vacuum conditions within the load lock 102.

Once the pressure within the entrance load lock 102 has returned to a sufficiently low level, the interior door 107 opens, and the rotating arm 110 removes the wafers from the load lock 102 and sequentially delivers the wafers to, and retrieves them from, each of the processing chambers 112. Within at least one of these chambers, chlorine gas is used to etch the wafers. Notwithstanding the operation of a cryopump 114 within the transfer chamber 108, some of the gas remains in its vapor phase and migrates through the chambers. Accordingly, when the interior door 107 to the entrance load lock 102 is opened, low levels of chlorine and other gas vapors typically migrate to the load lock 102 where they condense and gradually accumulate upon the cryopanel 114. If, at any time, the pump ceases operation or malfunctions, the condensed chlorine will sublimate from the cryopanel 114. When the exterior door 106 is reopened for the next cycle of processing, the released chlorine will escape from the load lock presenting a grave hazard for the individual reaching into the load lock 102 to insert the next load of wafers.

A similar hazard is created when this process is reversed at the close of the cycle. Upon completion of processing, the wafers are delivered to the exit load lock 104. Like the entrance load lock 102, the exit load lock 104 is subject to the migration of chlorine and other gases from the transfer chamber 108 when the interior door 107 is opened. A concentrated release of these gases, particularly chlorine, may then create a hazard for the operator when he reaches into the load lock 104 to retrieve the wafers after the exterior door 106 is opened to the outside atmosphere.

In addition to the hazards that chlorine poses in its $Cl_2$ vapor form, chlorine gas poses an additional threat because it can react with free or molecularly-bound hydrogen to form hydrochloric acid (HCl), a highly-corrosive chemical which also poses a significant health and environmental hazard. If formed within the surrounding chamber, hydrochloric acid is difficult to manage and will typically corrode the chamber interior as well as the exhaust equipment. Hydrochloric acid also presents a serious health hazard to anyone reaching into the chamber or sufficiently proximate to the chamber to inhale vapors released therefrom. Accordingly, preventing the formation of hydrochloric acid provides numerous benefits.

When a cryopump is regenerated, or when power is lost or the cryopump malfunctions, as described above, liberated gases routinely intermix and react with one another. Chlorine reacts readily with water in this context to produce hydrochloric acid. Water vapor is typically a significant constituent of ambient air. Accordingly, water condensate, i.e., ice, is commonly found on cryopanel surfaces. Because the vapor pressure of gases generally rises with increasing temperature, gases gradually sublimate from the cryopanel as the temperature of the cryopanel increases. The table, below, compares the temperatures at which a range of vapor pressures, P, are established for both chlorine and water.

| P (torr) | $T_{Cl}$ (K) | $T_{H2O}$ (K) |
|---|---|---|
| $10^{-9}$ | 80.0 | 137.0 |
| $10^{-8}$ | 84.4 | 144.5 |
| $10^{-7}$ | 89.4 | 153.0 |

-continued

| P (torr) | $T_{Cl}$ (K) | $T_{H2O}$ (K) |
|---|---|---|
| $10^{-6}$ | 95.1 | 162.0 |
| $10^{-5}$ | 101.5 | 173.0 |
| $10^{-4}$ | 109.0 | 185.0 |
| $10^{-3}$ | 117.5 | 198.5 |
| $10^{-2}$ | 127.5 | 215.0 |
| $10^{-1}$ | 140.0 | 233.0 |
| 1 | 155.0 | 256.0 |
| 10 | 173.0* | 284.0* |

$T_{cl}$ is the temperature at which chlorine exhibits the stated vapor pressure, and $T_{H20}$ is the temperature at which water exhibits the stated vapor pressure. Temperatures marked with an asterisk are above the triple point of that gas. If the vapor pressure is sufficient, chlorine will condense to form a liquid at temperatures greater than its triple point temperature. The formation of a liquid phase should be avoided, however, because the gas can be more effectively segregated and processed, by a scrubber, for example, when it is in the vapor phase.

The difference in vapor pressure for chlorine and water at any given temperature is correlated with the difference in the rates at which the gases will condense upon and sublimate from the cryopanel. When a roughing pump is used to maintain the ambient pressure within a chamber at a level of $10^{-3}$ torr, a gas at equilibrium will exist primarily as a solid condensate upon the cryopanel if the gas has a vapor pressure of less than $10^{-3}$ torr at the temperature of the cryopanel. If the vapor pressure of the gas is greater than $10^{-3}$ torr at the temperature of the cryopanel, the gas will exist, when at equilibrium, primarily in its vapor phase. As shown, chlorine reaches a vapor pressure of 0.1 torr at 140K. Because the vapor pressure of chlorine is above the ambient pressure, chlorine will exist substantially as a vapor at 140K. In contrast, the vapor pressure of water at this temperature is less than $10^{-8}$ torr. Because the vapor pressure of water is below ambient pressure, water exists substantially as a condensed solid at 140K. Accordingly, by warming a cryopanel to 140K and maintaining this temperature for a sufficient period of time, the chlorine can be substantially sublimated from the cryopanel and removed from the chamber while the water, which has a very low vapor pressure at 140K, remains substantially condensed.

Because water will sublimate from the cryopanel at temperatures below 150K only in very small quantities, interaction between the liberated chlorine and water is minimized, thereby limiting the opportunity for the vapors to react. To further reduce the concentration of residual chlorine vapor and further eliminate the opportunity for interaction between the chlorine vapor and the subsequently released water vapor, a turbo pump capable of reducing the vapor pressure to about $10^{-6}$ torr can be used. After the roughing or turbo pump has substantially removed the sublimated chlorine from the chamber, the temperature of the cryopanel can then be raised to sublimate the water condensate if a full regeneration is desired. Alternatively, the selective defrost procedure can be used to periodically flush the chlorine from the system to prevent dangerous accumulation of chlorine without performing a full regeneration. The chlorine can be selectively sublimated at temperatures much lower than those at which water releases in significant quantities. Therefore, chlorine can be flushed from the cryopanel with less heating and less subsequent cooldown than is required for a full regeneration. As a consequence, not only is the formation of hydrochloric acid reduced, but both time and energy is saved in a more efficient process.

Figure 3:
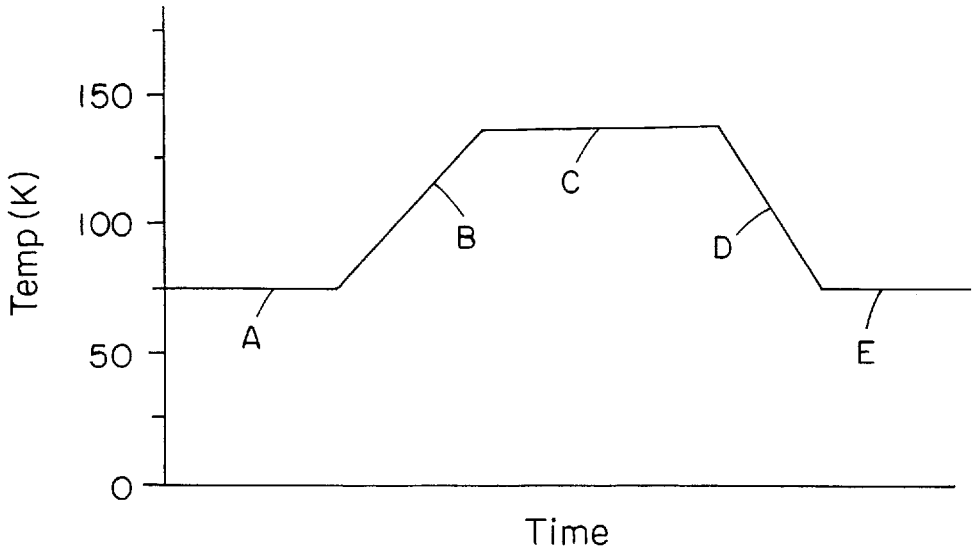
FIG. 3 charts a thermal profile of a single-stage cryopump undergoing a partial regeneration in which chlorine is selectively sublimated from the cryopanel.
Figure 4:
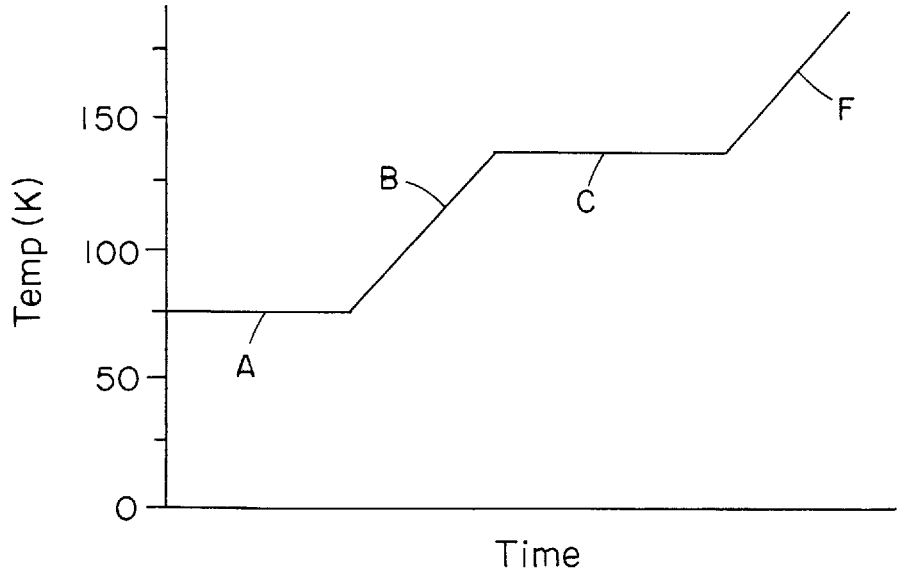
FIG. 4 charts a thermal profile of a single-stage cryopump undergoing a full regeneration in which chlorine is sublimated and removed before the other gases are released.

FIGS. 3 and 4 diagram a thermal profile of each of these selective defrosting procedures. FIG. 3 depicts the temperature profile of a single-stage cryopump undergoing a partial regeneration. The duration of such a procedure is typically about one hour. At step A, the cryopanel condenses ambient gases at its operating temperature of, for example, 75K. The partial regeneration commences at step B as the cryopanel is warmed by a heater from its operating temperature to 125K. Throughout step C, the cryopanel is held at approximately 125K until the transformation of chlorine between solid and vapor phases reaches equilibrium. The formation of liquid-phase chlorine is prevented by maintaining the temperature of the cryopanel below the chlorine triple point. The released chlorine is removed, in its vapor phase, from the surrounding process chamber by a roughing pump. After the chlorine has been substantially released from the cryopanel and removed from the chamber, the cryopanel is recooled, during step D to its operating temperature of 75K. At step E, the cryopanel resumes its normal pumping operation at the operating temperature.

FIG. 4 depicts the temperature profile of a cryopanel over the course of a full regeneration including a selective flush of chlorine. As before, the cryopanel is warmed, at step B, from its operating temperature to 125K where it is held while chlorine is selectively released during step C. After the chlorine is removed from the chamber, the heater is reactivated at step F, and the cryopanel is warmed to a temperature between 250K and room temperature. Nearly all remaining gases are thereby sublimated from the cryopanel, producing a clean cryopanel surface.

Full and partial regenerations, as described, may be performed in sequence over the course of operating a process tool. A partial regeneration can be performed at regular intervals to minimize the accumulation of chlorine condensate. A full regeneration can be performed at less frequent intervals to clean the cryopanel surface when it becomes overloaded with the condensate of other gases. Accordingly, a regeneration schedule can be devised whereby a series of partial regenerations can be performed over consecutive intervals followed by a full regeneration at, for example, every fifth interval.

In addition to managing the removal of chlorine, the methods of this invention can also be used to selectively sublimate fluorine gas from the second-stage cryopanel of a two-stage cryopump at a temperature near 55K. Like chlorine, fluorine presents a respiratory hazard and may react with water to form a corrosive acid, i.e., hydrofluoric acid, absent the controls provided by the methods of this invention.

While this invention has been particularly shown and described with references to preferred embodiments thereof, it will be understood by those skilled in the art that various changes in form and details may be made therein without departing from the scope of the invention as defined by the appended claims.

The invention claimed is:

1. A method for preferentially defrosting a cryopanel having at least two gases condensed upon it comprising the steps of:

warming the cryopanel to a temperature within a selective defrost range at which a first condensed gas selectively sublimates from the cryopanel into a chamber surrounding the cryopanel while water remains substantially condensed upon the cryopanel, the first condensed gas being reactive with water to produce an acid; and maintaining the temperature of the cryopanel within the selective defrost range until the first condensed gas is substantially released from the cryopanel and removed from the chamber.

2. The method of claim 1, wherein the first condensed gas includes a halogen.

3. The method of claim 2, wherein the selective defrost temperature range is below the temperature of the triple point of the first condensed gas.

4. The method of claim 3, wherein the first condensed gas is chlorine.

5. The method of claim 4, wherein the cryopanel is a component of a cryopump including a refrigerator that performs a Gifford-McMahon cooling cycle.

6. The method of claim 5, wherein the refrigerator is a single-stage refrigerator.

7. The method of claim 6, further comprising the step of further warming the cryopanel to perform a complete regeneration after the first condensed gas has been substantially removed from the chamber but before the cryopanel is re-cooled to prevent substantial further condensation of the first condensed gas between the substantial removal of the first condensed gas and the complete regeneration.

8. The method of claim 4, further comprising the step of maintaining the operating temperature of the cryopanel between about 50K to about 85K before warming the cryopanel to the selective defrost range.

9. The method of claim 8, wherein the cryopanel is a component of a cryopump including a single-stage refrigerator that performs a Gifford-McMahon cooling cycle.

10. The method of claim 9, further comprising the step of further warming the cryopanel to perform a complete regeneration after the first condensed gas has been substantially removed from the chamber but before the cryopanel is re-cooled to prevent substantial further condensation of the first condensed gas between the substantial removal of the first condensed gas and the complete regeneration.

11. The method of claim 1, further comprising the step of further warming the cryopanel to perform a complete regeneration after the first condensed gas has been substantially removed from the chamber but before the cryopanel is re-cooled to prevent substantial further condensation of the first condensed gas between the substantial removal of the first condensed gas and the complete regeneration.

12. A method for selectively defrosting a cryopanel within a chamber, the cryopanel having water and chlorine condensed upon it, the method comprising the steps of:

warming the cryopanel to a temperature between about 115K and 180K to vaporize the chlorine;

removing the chlorine vapor from the chamber; and maintaining the temperature of the cryopanel between about 115K and 180K until the chlorine vapor pressure within the chamber drops below about 0.01 torr.

13. A method for preferentially defrosting a cryopanel having at least two gases condensed upon it comprising the steps of:

warming the cryopanel to a temperature within a selective defrost range at which a first condensed gas selectively sublimates from the cryopanel while a second condensed gas remains substantially condensed upon the cryopanel, the first condensed gas being toxic to humans upon inhalation; and maintaining the temperature of the cryopanel within the selective defrost range until the first condensed gas is substantially released from the cryopanel.

14. The method of claim 13, wherein the cryopanel is a component of a cryopump including a refrigerator that performs a Gifford-McMahon cooling cycle.

15. The method of claim 14, wherein the refrigerator is a single-stage refrigerator.

16. A cryopump comprising:

a refrigerator;

a cryopanel in thermal contact with the refrigerator; and an electronic module programmed to:

warm the cryopanel to a temperature within a selective defrost range at which a first condensed gas selectively sublimates from the cryopanel while water remains substantially condensed upon the cryopanel, the first condensed gas being reactive with water to produce an acid, and maintain the temperature of the cryopanel within the selective defrost range until the first condensed gas is substantially released from the cryopanel.

17. The cryopump of claim 16, the refrigerator being a single-stage refrigerator and the selective defrost range consisting of temperatures between about 115K and about 180K.

18. An electronic module for controlling a cryopump having a cryopanel, the electronic module comprising electronics programmed to:

warm the cryopanel to a temperature within a selective defrost range at which a first condensed gas selectively sublimates from the cryopanel while water remains substantially condensed upon the cryopanel, the first condensed gas being reactive with water to produce an acid; and maintain the temperature of the cryopanel within the selective defrost range until the first condensed gas is substantially released from the cryopanel.

19. A method for vacuum pumping a cluster process tool comprising the steps of:

installing a single-stage cryopump within a transfer chamber of a cluster process tool; and maintaining the temperature of the cryopump within an operating temperature range of about 50K to about 85K between successive regenerations of the cryopump.

20. The method of claim 19, wherein the cryopump includes a refrigerator that performs a Gifford-McMahon cooling cycle.

21. The method of claim 20, wherein the refrigerator is a single-stage refrigerator.

22. The method of claim 19, wherein the temperature of the cryopump is maintained within an operating range of about 50K to about 85K.

23. The method of claim 22, wherein the cryopump includes a refrigerator that performs a Gifford-McMahon cooling cycle.

24. The method of claim 23, wherein the refrigerator is a single-stage refrigerator.

* * * * *